United States Patent [19]

Zirk, Sr.

[11] 4,048,458

[45] Sept. 13, 1977

[54] INDUCTION HEATING CORE STRUCTURE AND METHOD OF HEATING

[75] Inventor: Robert Louis Zirk, Sr., Huntley, Ill.

[73] Assignee: Illinois Tool Works Inc., Chicago, Ill.

[21] Appl. No.: 688,860

[22] Filed: May 21, 1976

[51] Int. Cl.[2] ..... H05B 5/08

[52] U.S. Cl. ..... 219/10.79; 156/275; 219/9.5; 219/10.53; 336/172

[58] Field of Search ..... 219/10.53, 10.79, 10.57, 219/10.41, 10.49, 10.43, 10.75, 230, 9.5; 336/216, 211, 233, 212, 172, 173, 184; 156/272, 275, 380

[56] References Cited

U.S. PATENT DOCUMENTS

| | | | |
|---|---|---|---|
| 1,849,485 | 3/1932 | Gibbs et al. | 336/172 |
| 2,116,119 | 5/1938 | Loewenstein | 175/133 |
| 2,706,234 | 4/1955 | Macy | 219/10.79 |
| 2,902,572 | 9/1959 | Lackner et al. | 219/10.79 |
| 3,260,976 | 7/1966 | Eissmann | 336/172 |
| 3,472,992 | 10/1969 | Geisel et al. | 219/10.79 |
| 3,883,712 | 5/1975 | McBriarty | 219/10.53 |

FOREIGN PATENT DOCUMENTS

| | | | |
|---|---|---|---|
| 681,018 | 8/1939 | Germany | 219/10.79 |

*Primary Examiner*—Bruce A. Reynolds
*Attorney, Agent, or Firm*—Thomas W. Buckman; Robert W. Beart

[57] ABSTRACT

An induction heating coil and core structure which provides two distinct magnetic circuits, with the materials to be heated also forming a part of the circuits so that juxtaposed workpieces can be joined together with a layer of heat activatable adhesive by a unitary core structure. A pair of nested U-shaped cores have a differing number of exciter coil turns with at least one common turn wrapped about each of the members to produce a greater amount of flux density in one core than the other to effect a different heat rate between the workpieces which complete each magnetic circuit.

7 Claims, 5 Drawing Figures

INDUCTION HEATING CORE STRUCTURE AND METHOD OF HEATING

BACKGROUND OF THE INVENTION

This invention relates generally to structure and method for effecting an adhesive bond through the use of induction heating and heat activatable adhesive.

The invention more specifically relates to a unitary, composite core structure of a U-shaped variety, capable of heating juxtaposed workpieces at differing rates.

A variety of systems are known for activating an adhesive layer between a pair of adherend surfaces through the use of application of heat. Perhaps the most desirable technique to activate such adhesive would be to subject the entire environment simultaneously to a heat source for a predetermined time duration. The time duration would preferably be the amount of time required to bring the adhesive to its desired temperature. Such a technique would heat each of the adherend surfaces as well as the adhesive which would promote an effective bond at each bonding surface. However, this type of total heating is often impractical and not desirable for a variety of reasons. The size and configuration of the parts to be heated often do not lend themselves to such a heating concept. Also, the total heating of a part may heat areas that are not intended to be heated and could conceivably damage certain areas of the part.

For these reasons, selective region heating has been utilized to produce a proper bond between two surfaces. Typical of such methods are induction heating methods using a variety of shapes and configurations of coil and core structures. One of the most advantageous and efficient coil and core structures utilized in the prior art incorporates a generally U-shaped core with an exciter winding placed thereabout so that the core can be positioned with the legs in direct contact with the workpiece to be heated. Upon application of current to the coil, a magnetic circuit is formed in the core and is completed through the workpiece. The core is structured so as to reduce heat looses within the core itself but to permit heat losses, resulting from eddy currents and hysteresis, to be isolated in the workpiece in a selected area located between the legs of the core. This type of a structure effectively heats a small area with little or no flux loss to the surrounding environment. In using such a system to activate heat activatable adhesive, the core is positioned in contact with, or in close proximity to, one of the two juxtaposed adherend surfaces so as to complete the magnetic circuit. This requires that the heat generated in the adherend surface be transferred to the adhesive positioned between the surfaces to properly activate and create a bond between the surfaces. Since adhesive is of an insulative material, quite often the proper heat does not reach the surface opposing the adherend surface which generates the heat. Since a proper bond requires a good "wetting" or bonding interface between the adhesive and both of the opposing adherend surfaces, it is important that the predetermined temperature level exist at both interface surfaces at substantially the same time.

Using such a single U-core system, one surface of the adhesive is either overheated or underheated if the other surface has obtained the proper heat.

Problems of this type are multiplied when workpieces of substantially different mass are to be adhered together since a greater amount of watts per pound will be required to bring the adherend surface of the larger mass to a proper temperature than would be to bring the adherend surface of the smaller mass to the proper temperature.

SUMMARY OF THE INVENTION

According to the present invention, it has been found that an induction heating system utilizing a U-shaped core can be made more efficient and adaptable for bonding two workpieces of differing masses together. The present invention utilizes a pair of U-shaped cores nestably arranged relative to one another with an exciter coil wrapped about both of the cores so that at least a single winding is common to both cores and providing a different number of turns around one core than about the other.

The use of an outer U-shaped core arranged above a smaller U-shaped core permits the smaller core to be associated with a smaller mass material while the upper and larger core is associated with the larger mass material. The nestable arrangement of cores associated with workpieces so that the adhesive layer interposed between the material can essentially be heated from both sides of the adhesive layer achieving the proper temperature level from both sides at a predetermined time.

The teachings of this invention will enable such a composite core structure to be potted and unitized as a single heating head.

An important object of the invention is, therefore, to provide a composite coil and core structure capable of heating a pair of juxtaposed surfaces at differing rates so as to achieve a proper bond between the two surfaces.

A further object of the invention is to provide a structure and method of heating permitting a small mass item to be properly, adhesively bonded to the large mass item. The above and other objects and advantages of the invention will become apparent upon review of the following detailed description when considered in connection with the accompanying drawings.

DETAILED DESCRIPTION OF THE INVENTION

Figure 1:
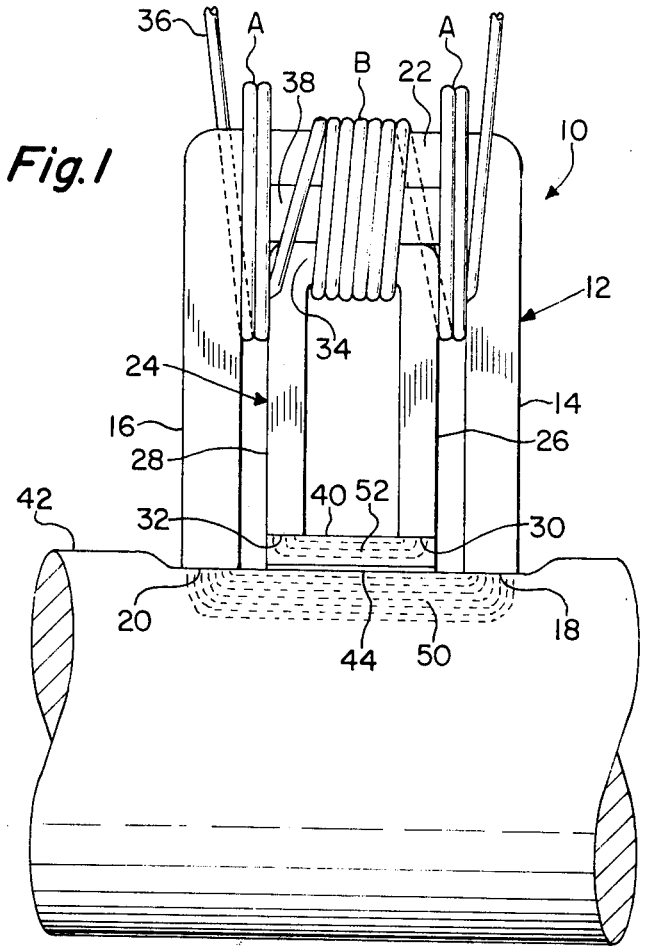
FIG. 1 is a front elevation view showing the composite core structure in use attaching a small mass body to a large mass body with an adhesive bond therebetween.

Referring to FIG. 1 of the drawings, the composite structure 10 basically comprises a first U-shaped core 12, a second U-shaped core 24 nestably arranged beneath the first core and an exciter coil 36 would about portions of each of the cores. It will be noted, that the number of turns that coil 36 makes about the outer core 12 is different than the number of turns that it makes about the innermost core 24. In particular, it will be noted that the coil 36 includes regions A and B. Region B being turns of the coil that are simultaneously wrapped about both the core 12 and the core 24. Regions A are portions of the coil which form turns about only the outermost core 12.

In keeping with the invention, each of the cores is generally U-shaped including a pair of legs that are connected by a bight portion. For example, outer core 12 will include a pair of legs 14 and 16 with a pair of end surfaces 18 and 20 respectively at the free extremities and interconnected at the uppermost regions by a bight portion 22. The smaller, innermost core 24 will similarly include a pair of leg sections 26 and 28 with end surfaces 30 and 32 at the free extremity thereof and interconnected at the uppermost extremity by a bight portion 34.

Figure 2:
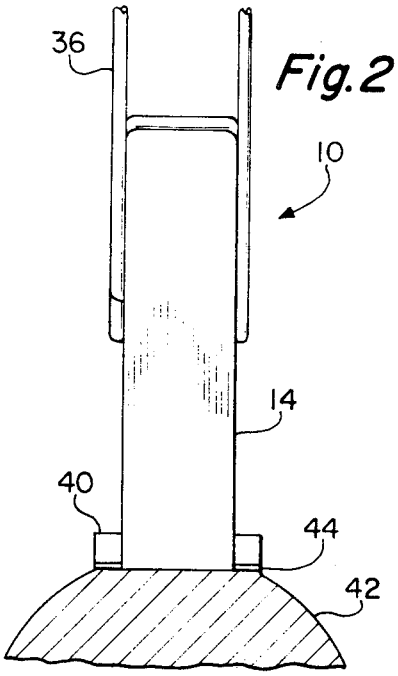
FIG. 2 is a side elevation view of the core structure and workpieces shown in FIG. 1.

In the embodiment shown in FIGS. 1 and 2, the coil 36 will thus form a plurality of turns wrapped about the bight portion 22 of core 12 and including both of regions A and B as shown in FIG. 1. In contrast, the innermost core 24 will be wrapped by only the number of turns shown in Region B of the coil 36. Since flux density is largely dependent on the number of turns surrounding a core, the flux density created in the core 12 will be greater than the flux density created in the core 24.

To facilitate the manufacture and winding of the coil about the nesting cores, an insulative bobbin or spacer material 38 may be positioned between the bight portions of the two cores. The structure just described may be unitized in a conventional manner by potting or coating the entire structure with an insulative material as long as little or no coating exists at the end faces of the core legs.

The invention described herein is particularly effective in adhesively bonding a member of small mass, such as ferromagnetic weight 40, to a material of larger mass, such as a drive shaft 42 of suitable ferromagnetic material. Upon energization of coil 36, a flux path 50 will be formed in the outer core 12 with the skin surface of the larger mass workpiece 42 forming a link between legs 14 and 16 and completing the flux circuit. Simultaneous to the creation of the flux path in the outer core, a flux path 52 is created in inner core 24 as a result of the coil section B. The small weight 40 forms the link between the legs 26 and 28 of inner core 24 to complete the flux circuit therein. The flux passing through both the small mass 40 and the large mass 42 creates heat losses from eddy currents, hysteresis or the like in these workpieces. The heat thus generated in the ferromagnetic workpieces 40 and 42 is rapidly transferred to the adhesive layer 44. It should be carefully noted that the technique of heating of this invention permits heat to be transferred at the interface of the small weight 40 and adhesive layer 44, as well as at the interface between the large mass 42 and adhesive layer 44.

Due to the larger number of turns about the outer core than about the inner core, the heating rate of the larger mass 42 is greater than the heating rate of the smaller mass 40. Due to the relative sizes, more power is needed to heat the drive shaft in this example than is needed to heat the balance weight. As a result of the configuration of this invention, the temperature required to adequately flow or cure adhesive layer 44 to present an effective bond at each of the interfaces is achieved and the proper temperature level is attained at each interface at substantially the same due to the relationship of the variable heating rates to the variable masses.

Figure 3:
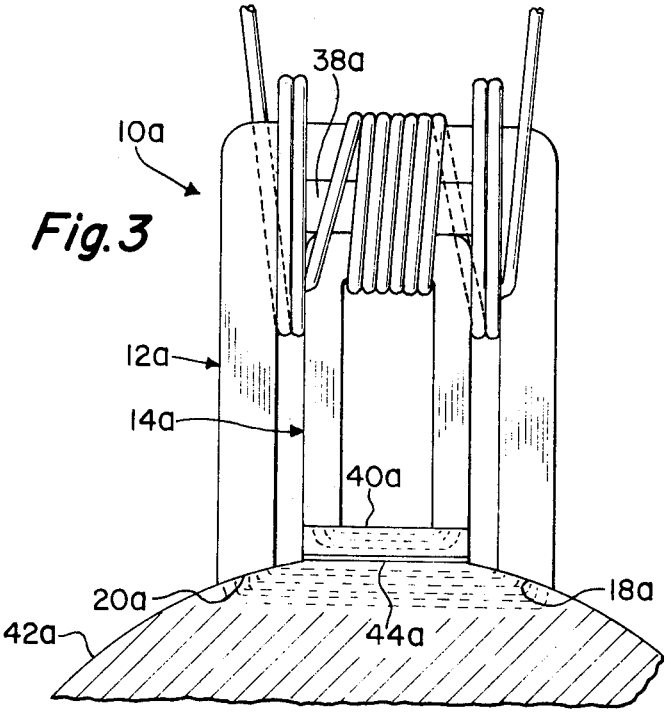
FIG. 3 is a front elevational view of a modified embodiment of the composite core structure in use.

It should be apparent that the differential heating rates to the different adherend or faying surfaces can be utilized with a variety of configurations and shapes of workpieces. For example, the end faces **18*a* and 20*a* of a composite unit 10*a* can be configured to closely couple with an arcuate workpiece as shown in FIG. 3**.

Figure 4:
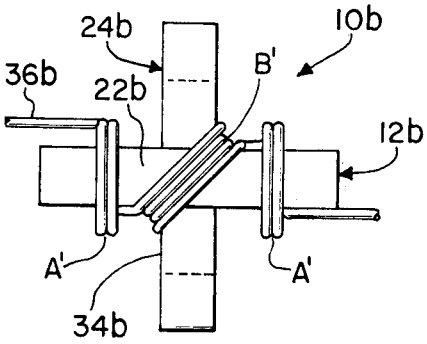
FIG. 4 is a top view of a further embodiment of the composite core structure in accordance with the invention.
Figure 5:
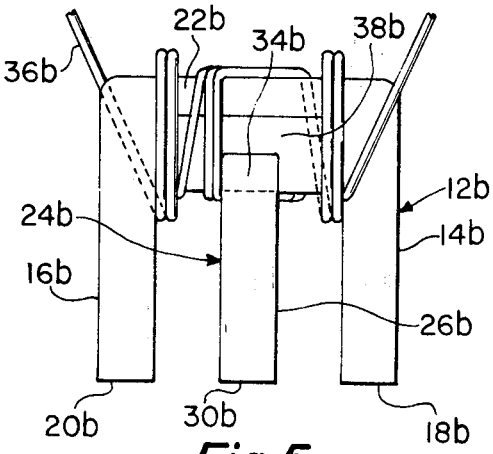
FIG. 5 is a front elevation view of the embodiment of the composite core structure shown in FIG. 4.

In keeping with the basic principles of the invention, the structure of the core can be slightly modified to accommodate a variety of lengths or widths of a small mass workpiece. Turning to FIGS. 4 and 5, an example of a composite core structure **10*b* is shown which places the innermost core 24*b* in a plane which is transverse to the plane which the outermost core 12*b* is positioned. This will enable the end faces 30*a* and 32*b* of the inner core to be positioned adjacent the extremities of an oversized small mass workpiece, while the end surfaces 18*b* and 20*b* are positioned in contact with a selected region of a larger mass workpiece as described above relative to the FIG. 1 embodiment. In further keeping with the invention, the coil 36*b* is wound about the core structure so that it comprises two sections of turns A′ and B′ with B′ being wound about both the bight portion 22*b* of the outer core as well as about 34*b* of the inner core. The remaining turns A′ in addition to B′ constitute the total number of turns about the outer core. In keeping with the principles of this invention, a greater number of watts per pound heating rate is provided to the larger mass workpiece as a result of core 12*b* than is provided in the smaller mass workpiece from inner core 24*b***.

Throughout the various figures of the invention described herein, like reference numerals with suffixes *a* or *b* are intended to designate similar elements or components.

Thus it is apparent that there has been provided in accordance with the invention a composite coil and core structure that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variation as fall within the spirit and broad scope of the appended claims.

I claim:

1. A composite core and coil structure for use in heating workpieces by induction, including a first generally U-shaped core and a second generally U-shaped core nestably associated with the first core, exciter coil means wrapped about portions of each core providing at least one turn which simultaneously encircles portions of both cores, the coil means providing a predetermined number of turns about the first core different than the number of turns about the second core, the length of the legs portions of the first core are greater than the length of the leg portions of the second core.

2. The composite coil and core structure of claim 1, wherein the exciter coil encircles the bight portions of both cores.

3. The composite coil and core structure of claim 1, wherein the first core is provided with a greater number of turns of the exciter coil than the second core.

4. The composite coil and core structure of claim 1, wherein the cores are arranged so that the bight and leg portions of the first core are substantially coplanar with the bight and leg portions of the second core.

5. The composite coil and core structure of claim 1, wherein the cores are arranged so that the bight and leg portions of the first core extend in a plane transverse to the plane including the bight and leg portions of the second core.

6. The composite coil and core structure of claim 4, wherein the length of the bight of the first core is greater than the lengths of the bight and leg portions of the second core.

7. A method of adhesively securing a first metallic workpiece of predetermined volume to a second metallic workpiece of a greater total volume, including the steps of placing the first workpiece on the second workpiece with a layer of heat activable adhesive therebetween, heating by induction, both workpieces simultaneously from a single side so that the faying surface of each will reach a predetermined temperature substantially simultaneously, wherein the induction heat is provided by a pair of nested U-shaped cores with an exciter coil wound about their bight portions so that the outermost core has more windings than the inner core, the outermost core legs contacting the second workpiece while the inner core legs contact the first workpiece whereby the second workpiece will be subjected to a greater amount of heating flux than the first workpiece.

* * * * *